United States Patent [19]

Hirata et al.

[11] 4,412,469

[45] Nov. 1, 1983

[54] TURRET PUNCH PRESSES HAVING TOOL HOLDERS ROTATABLY MOUNTED IN THE TURRETS

[75] Inventors: Tadashi Hirata, Yamato; Katsuyoshi Sakamoto, Isehara, both of Japan

[73] Assignee: Amada Company, Ltd., Japan

[21] Appl. No.: 244,900

[22] Filed: Mar. 18, 1981

[30] Foreign Application Priority Data

Mar. 18, 1980 [JP] Japan ..... 55/033330

[51] Int. Cl.[3] ..... B26F 1/14

[52] U.S. Cl. ..... 83/552; 83/556

[58] Field of Search ..... 83/549–552, 83/556, 559, 71

[56] References Cited

U.S. PATENT DOCUMENTS

| | | | |
|---|---|---|---|
| 3,370,492 | 2/1968 | Treff | 83/556 X |
| 3,449,991 | 6/1969 | Daniels | 83/552 X |
| 3,686,992 | 8/1972 | Daniels | 83/552 X |
| 4,144,783 | 3/1979 | Yamazaki et al. | 83/556 X |
| 4,285,259 | 8/1981 | Jelinek et al. | 83/552 |

*Primary Examiner*—James M. Meister

*Attorney, Agent, or Firm*—Wigman & Cohen

[57] ABSTRACT

A turret punch press having a pair of upper and lower turrets ono which a plurality of pairs of upper and lower punching tools are mounted to punch a variety of holes in sheet materials is disclosed. Each of the upper and lower turrets is synchronously rotatable such that the upper and lower punching tools may be synchronously rotated or indexed in order to punch holes of the same size and shape, but different orientation, in the sheet material.

4 Claims, 4 Drawing Figures

TURRET PUNCH PRESSES HAVING TOOL HOLDERS ROTATABLY MOUNTED IN THE TURRETS

BACKGROUND OF THE INVENTION

1. Field of the Invention

The present invention relates generally to turret punch presses having a pair of upper and lower turrets on which a plurality of pairs of upper and lower punching tools can be mounted to punch a variety of holes in sheet materials such as sheet metals. More particularly, the present invention relates to apparatus for synchronously indexing or rotating the upper and lower punching tools in the upper and lower punching turrets in such turret punch presses to make the best use of the punching tools.

2. Description of the Prior Art

As is well known, a turret punch press comprises a vertically movable ram and a pair of rotatable upper and lower turrets for holding a plurality of upper and lower punching tools which are varied in size and shape to punch a variety of holes in sheet materials such as sheet metals. The upper and lower turrets are substantially vertically spaced from each other beneath the ram. The turrets are horizontally disposed on their respective shafts which are vertically disposed so as to coaxially align with each other. Each of the upper punching tools on the upper turret is so located as to vertically align with either of the lower punching tools on the lower turret to cooperate with each other to punch holes of a particular shape. Also, the upper and lower turrets are so arranged as to be simultaneously power rotated to bring a desired pair of the upper and lower tools into position just beneath the ram so as to enable them to be worked by the ram to punch holes of a desired shape. In this arrangement, a workpiece, such as a sheet metal to be punched, is horizontally fed by a plurality (usually a pair) of clamping means into position between the upper and lower turrets. The punching is accomplished by the upper and lower punching tools which have been placed just beneath the ram by the upper and lower turrets. The clamping means are so arranged as to grip an end of the workpiece and be moved by power along both the X and Y axes in all directions toward and away from the upper and lower turrets. This brings any portion of the workpiece into position beneath the ram. Also, in order to automatically and continuously punch a number of holes which vary in size and shape in the workpiece, the upper and lower turrets and the clamping means are so arranged as to be rotated and moved under a preprogrammed numerical control.

During punching operations in the turret punch presses as described above, it is very often desired to punch a plurality of holes which are all the same in shape and size but which are different in direction in the worksheets. For example, there are instances where it is desired to punch many holes in a workpiece of T-shape and inverted T-shape. These are quite identical in shape and size and differ only in direction. As another example, it is often necessary to punch many I-shaped holes, identical in shape and size, but at different angles to an edge of the workpiece, in order to punch a radial shape in the workpiece. Of course, there are cases where it is desired to punch holes of identical shape and size in one direction in some workpieces and in different directions in other workpieces.

In conventional turret punch presses, however, it has been impossible to satisfactorily punch holes identical in shape and size but in different directions in workpieces in an economical manner. For instance, in order to punch holes in different directions in workpieces, a desired pair of the upper and lower punching tools of a desired shape and size are manually adjusted in direction in the upper and lower turrets in a conventional turret punch press. As a matter of course, however, it is very difficult and time-consuming to accurately align the upper and lower punching tools in a desired direction in the upper and lower turrets in this manner. Therefore, for the purpose of easy alignment, each of the upper and lower punching tools is provided with an alignment key. Each of the upper and lower turrets is also configured with a plurality of grooves with which the alignment key is selectively engaged in some of these conventional turret punch presses. In this manner, however, it is of course impossible to steplessly adjust the direction of the upper and lower punching tools in the upper and lower turrets to punch holes common in shape and size in all directions in workpieces. Also, it is still time-consuming and troublesome to manually change the direction of the upper and lower punching tools in the upper and lower turrets. Furthermore, the arrangement is costly and requires a plurality of grooves in the upper and lower turrets. However, the great disadvantage of the prior art devices is that it is impossible to continuously punch holes which are identical in shape and size and different in direction without discontinuing the punching operation in the configurations in which the upper and lower punching tools have to be manually changed in direction in the upper and lower turrets. In order to punch holes different in direction in workpieces in this manner, it is necessary to discontinue the punching operation to change the upper and lower punching tools in direction after having punched holes common in direction. For the above described reasons, it has often been the case that many pairs of upper and lower punching tools which are the same shape and size are mounted together on the upper and lower turrets to continuously punch a variety of holes, including those which have a common shape and size and are different only in direction. In such a case, however, the cost for the upper and lower tools is inevitably high. Also, only a limited number of pairs of the upper and lower punching tools can be mounted on the upper and lower turrets.

SUMMARY AND OBJECTS OF THE INVENTION

It is a general object of the present invention to provide a turret punch press in which holes which are identical in shape and size and different in direction can be accurately and economically punched in workpieces.

It is a specific object of the present invention to provide a turret punch press in which a pair of upper and lower punching tools can be effectively versatilely used to easily punch holes of identical shape and size and different direction in workpieces.

It is also an object of the present invention to provide a turret punch press in which the upper and lower punching tools can be automatically synchronously rotated or indexed in the upper and lower turrets.

According to the present invention, these objects are basically accomplished by rotatably mounting the upper and lower punching tools on the upper and lower turrets and providing driving means for synchronously rotating the upper and lower punching tools.

It is another object of the present invention to provide a turret punch press in which the upper and lower punching tools can be automatically synchronously rotated in the upper and lower turrets but can be automatically fixed thereon by means of a clutch and brake means.

It is still another object of the present invention to provide a turret punch press which can be easily inspected to determine whether or not the upper and lower punching tolls are at their original locations in the upper and lower turrets.

It is a further object of the present invention to provide a turret punch press in which the upper and lower punching tools can be automatically synchronously rotated or indexed in the upper and lower turrets under a numerical control to continuously punch a variety of holes including those which are identical in shape and size and different in direction.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENTS

Figure 1:
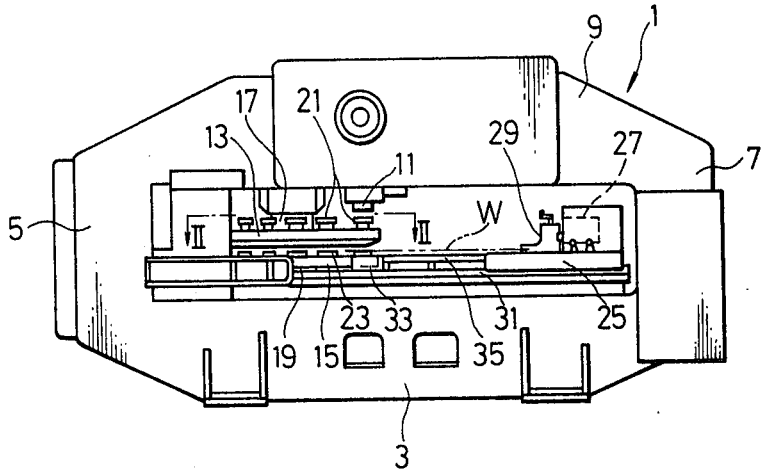
FIG. 1 is a front elevational view of a turret punch press embodying the principles of the present invention.
Figure 2:
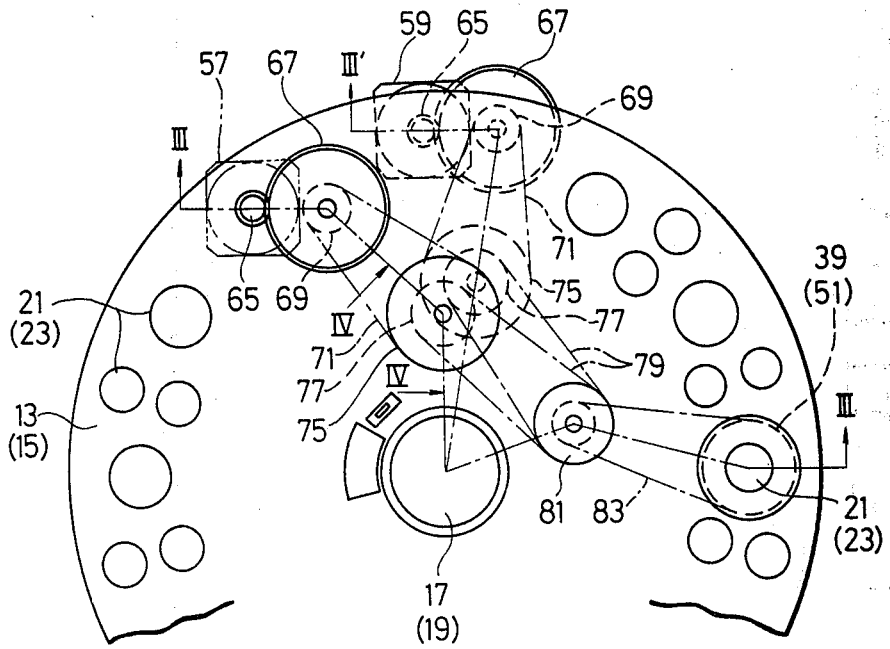
FIG. 2 is a plan view showing a portion of the turret punch press shown in FIG. 1 in section taken along the lines II—II of FIGS. 1 and 3.

Referring to FIG. 1, there is shown a turret punch press which is generally designated by the numeral 1 and is constructed of a base 3, a pair of side frames 5 and 7 vertically fixed to the ends of the base 3 and an overhead frame 9 which is supported by the side frames 5 and 7. In this connection, however, the turret punch press 1 can be so constructed as to be of a C-shaped frame in which the side frame 7 is omitted and the overhead frame 9 is a little shorter, although it is shown as being of a bridge-shaped frame in the preferred embodiment. The turret punch press 1 comprises a ram 11 and an upper turret 13 and a lower turret 15 having shafts 17 and 19, respectively and holding a plurality of upper punching tools 21 and lower punching tools 23 which are of different sizes and shapes. The ram 11 is vertically movably mounted at the substantially midway portion of the overhead frame 9 and vertically power driven to act on the upper and lower punching tools 21 and 23 placed therebeneath. The upper turret 13 is so mounted as to rotatably hang from the overhead frame 9 with its shaft vertical to rotate partially beneath the ram 11, while the lower turret 15 is rotatably mounted on the base 3 just beneath the upper turret 13 in a coaxial relation therewith. Also, the upper and lower turrets 13 and 15 are so arranged that pairs of the upper and lower punching tools 21 and 23, common in size and shape, vertically align with each other. In this arrangement, they are simultaneously power driven to bring a desired pair of the upper and lower punching tools 21 and 23 into position beneath the ram 11. As seen from FIG. 2, the pairs of the upper and lower punching tools 21 and 23 are typically mounted on the upper and lower turrets 13 and 15 to stand in a circle along the peripheries thereof. They are mounted an equal radial distance from the axes of the shafts 17 and 19 of the upper and lower turrets 13 and 15.

In order to feed and position the workpiece W to be punched, the turret punch press 1 is provided with a first carriage 25 which is movable toward and away from the upper and lower turrets 13 and 15 and a second carriage 27 which is slidably mounted on the first carriage 25 and holds a clamping apparatus 29 for clamping the workpiece W. The first carriage 25 is slidably mounted on rails 31 which are fixed on the upper portion of the base 3 so that the carriage may be moved horizontally toward and away from the upper and lower turrets 13 and 15 when driven by power. The second carriage 27, holding the clamping apparatus 29, is mounted on the first carriage 25 so that it may be moved horizontally by power in directions at right angles with the rails 31. Also, a fixed table 33 is provided on the base 3 so that the workpiece W can be slid thereon. Furthermore, a pair of movable tables 35 may be fixed to the first carriage 25 to hold the extending ends of the workpiece W.

In the above described arrangement, the workpiece W which is grapped by the clamping apparatus 29 can be fed into position between the upper and lower turrets 13 and 15 and positioned just beneath the ram 11 by moving the first and second carriages 25 and 27. Before, or as soon as the workpiece W is positioned between the upper and lower turrets 13 and 15 just beneath the ram 11, a desired pair of upper and lower punching tools 21 and 23 are placed just beneath the ram 11 by the upper and lower turrets 13 and 15. Thus, the workpiece W is punched by the upper and lower punching tools 21 and 23 when the ram 11 is lowered to press the upper punching tool 21. Also, a number of holes differing in size and shape are automatically and continuously punched in the workpiece W by moving the upper and lower turrets 13 and 15 and the first and second carriages 25 and 27 under a preprogrammed numerical control.

Figure 3:
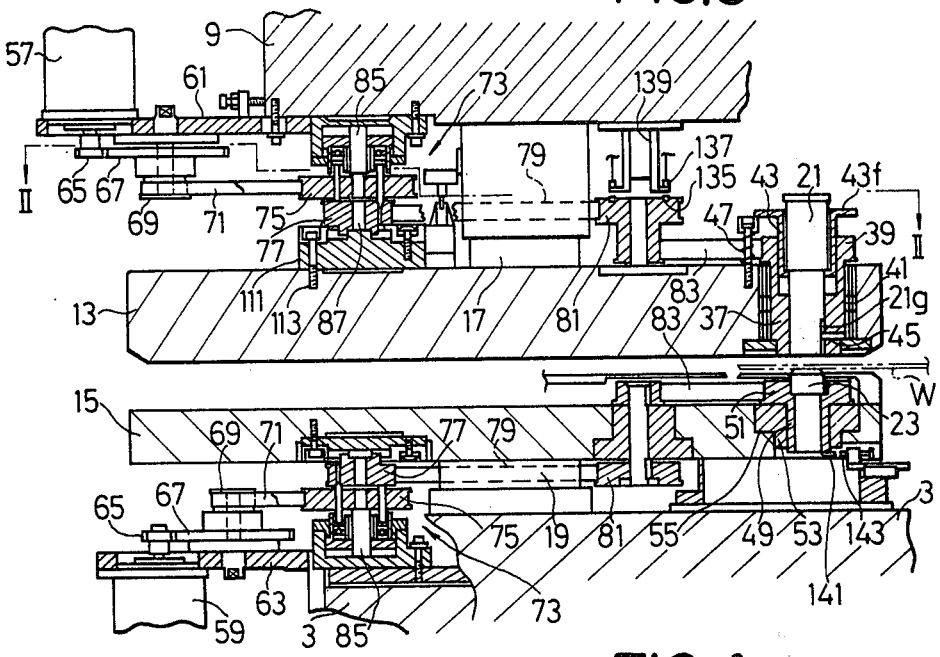
FIG. 3 is a sectional view of a portion of the turret punch press shown in FIG. 1 and shows the upper and lower portions in sections substantially taken along lines III—III and III'—III, respectively, of FIG. 2.

Referring now to FIG. 3, the upper punching tool 21 is vertically and detachably retained in a cylindrical holding member 37 which has an interior bore for holding the upper punching tool 21 and is provided at its top end with a pulley 39. The upper holding member 37 is vertically and rotatably held in a bore 41 vertically formed through the upper turret 13 is such a manner as to enable the upper punching tool 21 to project downwardly out of the upper turret 13. The upper portion of the upper punching tool 21 is slidably inserted in a cylindrical lifter member 43 which is provided at its top end with a flange 43*f* and is vertically slidably inserted in the upper enlarged portion of the bore 41. The upper punching tool 21 is formed at its lower portion with a vertical groove 21*g* and is guided for vertical sliding by a key member 45. The key member 45 is fixed to the upper holding member 37 in engagement with the groove 29. Also, the lifter member 43 is kept upwardly biased by a spring or springs 47 engaging the flange 43*f* thereof to hold and keep the upper punching tool 21 upwardly biased. Thus, the upper punching tool 21 will be lowered to project downwardly out of the upper turret 13 to punch when depressed by the ram 11, and it will be lifted upwardly by the spring or springs 47 by lifter member 43 after punching. Also, it will be understood that the upper punching tool 21 will be rotated or indexed in direction with regard to the upper turret 13 when the pulley 39 of the cylindrical upper holding member 37 is driven in either direction to rotate the upper holding member 37 in the bore 41 formed in the upper turret 13.

On the other hand, the lower punching tool 23 is located just beneath the upper punching tool 21 and is detachably retained in a cylindrical lower holding member 49. This holding member 49 is formed with a vertical interior bore and is provided at its top end with a pulley 51. The lower holding member 49 is in coaxial relation with the upper holding member 37 and is rotatably held by an annular supporting member 53 which is fixedly held in a bore 55 vertically formed through the lower turret 15. Thus, the lower punching tool 23 will cooperate with the upper punching tool 21 to punch holes in the workpiece W placed thereon when the upper punching tool 21 is depressed by the ram 11 to project out of the upper turret 13 into the lower punching tool 23. Also, the lower punching tool 23 may, in the same manner as the upper punching tool 21, be rotated or indexed in direction with regard to the lower turret 15 when the pulley 51 of the cylindrical lower holding member 49 is driven in either direction to rotate the lower holding member 49 in the supporting member 53.

In order to rotate or index the upper and lower punching tools 21 and 23 in the upper and lower turrets 13 and 15, the pulleys 39 and 51 of the upper and lower holding member 37 and 49, respectively, are so arranged as to be driven by motors 57 and 59, respectively. These motors may be servomotors. The motor 57 for rotating the upper punching tool 21 is held by a bracket 61 which is fixed to a portion of the overhead frame 9, while the motor 59 for the lower punching tool 23 is held by another bracket 63 which is fixed to a portion of the base 3. The upper and lower pulley 39 and 51 are so arranged as to be driven by the motors 57 and 59 in the same manner through transmitting elements of which are common to each other, although they are symmetrically disposed. Therefore, only the upper transmitting means connecting the upper motor 57 and the upper holding member 37 will be described, and the lower transmitting means for the lower motor 59 and the lower holding member 59 will not be described and will be only given reference numerals common to the upper transmitting means.

As seen from FIG. 3, the motor 57 is provided at its output vertically with a gear 65 which is downwardly depending. The gear 65 is in engagement with another gear 67 which is freely rotatably disposed together with a pulley 69 at the bracket 61. The pulley 69 is connected by a transmitting member 71, such as a belt, to a clutch and brake means 73. The brake means has a driving pulley 75 driven by the transmitting member 71 and a driven pulley 77, which will be described in greater detail hereinafter. The driven pulley 77 of the cluth and brake means 73 is connected by a transmitting member 79, such as a belt, to an idler pulley 81 which is freely rotatably mounted on the top surface of the upper turret 13. Also, the idler pulley 81 is connected by a transmitting member 83, such as a belt, to the pulley 39 of the upper holding member 37 so as to rotate or index the upper punching tool 21.

Although the transmitting means for the upper motor 57 has been described above, the lower motor 59 is connected to the pulley 51 of the lower holding member 49 in the more or less same manner to rotate or index the lower punching tool 23. In this arrangement, the upper and lower motors 57 and 59 are so designed as to be numerically controlled to synchronously drive the upper and lower pulleys 39 and 51 of the upper and lower holding members 37 and 49 in either direction to thereby synchronously rotate or index the upper and lower punching tools 21 and 23.

Figure 4:
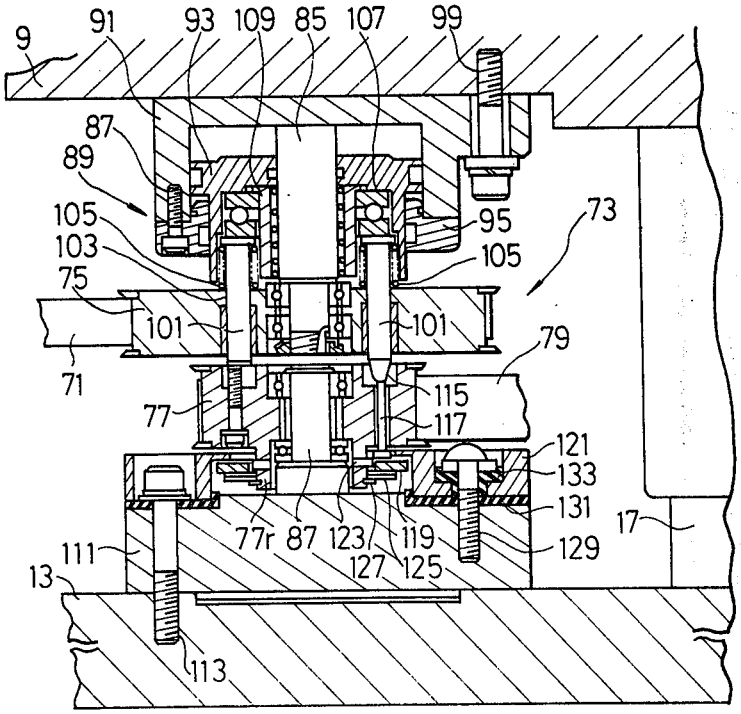
FIG. 4 is an enlarged sectional view of a portion of FIG. 2 shown in section taken along the line IV—IV of FIG. 2.

As best shown in FIG. 4, the clutch and brake means 73 comprises an upper shaft 85 for the driving pulley 75 and a lower shaft 87 for the driven pulley 77. These pulleys are vertically fixed to the overhead frame 9 and the upper turret 13, respectively, so that the lower shaft 87 may be in coaxial relation with the upper shaft 85 when brought into position therebeneath. The clutch and brake means 73 also comprises a pneumatic or hydraulic motor 89 comprising a cylinder 91, a piston 93 vertically slidably enclosed in the cylinder 91 and an annular cap 95 fixed to the cylinder 91 by a plurality of bolts 97. The cylinder 91 of the motor 89 is fixed to the underside of the overhead frame 9 by a plurality of bolts 99 in the preferred embodiment. The upper shaft 85 of the driven pulley 75 is vertically fixed at and along the center of the cylinder 91 through the piston 93 through the center therof.

The piston 93 of the motor 89 is so arranged as to vertically slide in the cylinder 91 along the upper shaft 85 toward and away from the driving pulley 75 to push and release a plurality of locating push rods 101. These push rods 101 vertically slidably extend through bores 103 formed in the driving pulley 75. In order to upwardly bias both piston 93 and the locating push rods 101, a plurality of springs 105 are provided. In the preferred embodiment, the springs 105 are disposed around the locating push rods 101 so as to keep the piston 99 upwardly biased by means of the locating push rods 101, as seen from FIG. 4. Also, the locating push rods 101 are kept upwardly biased by the springs 105 to remain normally retracted in the bores 103 of the driving pulley 75. They are so arranged as to project downwardly out of the driving pulley 75 against the springs 105 when the piston 93 is lowered. In the preferred embodiment, the piston 93 is maintained upwardly biased by the springs 105 and the locating push rods 101 by a thrust bearing 107 enclosing the upper shaft 85. Also, a ball bush 109 is provided between the thrust bearing 107 and the upper shaft 85 embodiment. Thus, the piston 93 will be lowered to push the locating push rods 101 when the motor 89 is supplied with pneumatic or hydraulic fluid, and it will be raised by springs 105 to release the locating push rods 101 when the pneumatic or hydraulic fluid is exhausted from the motor 89. In this arrangement the driving pulley 75 can be rotated on the upper shaft 85 at any time when driven by the transmitting member 71. Also, the locating push rods 101 will be downwardly projected out of the driving pulley 75 when the piston 93 is downwardly pressed by pneumatic or hydraulic fluid.

On the other hand, the lower shaft 87 of the driven pulley 77 is vertically fixed to a block member 111 which is mounted on the top surface of the upper turret 13 and fixed thereto by a plurality of bolts 113. The driven pulley 77 is freely rotatably held by the lower shaft 87 and is formed with a plurality of vertical bores 115 with which the locating push rods 101 can engage when lowered by the piston 93. Thus, the driven pulley 77 will be connected with the driving pulley 75 by the locating push rods 101 to be rotated when the piston 93 is depressed by the pneumatic or hydraulic fluid to enable the locating push rods 101 to project out of the driving pulley 75 into engagement with the vertical bores 115 of the driven pulley 75. However, when the pneumatic or hydraulic fluid has been exhausted from the motor 89, the driven pulley 77 will be disconnected from the driving pulley 75 since the locating push rods 101 are upwardly biased together with the piston 93 by the springs 105 to stay retracted into the driving pulley 75 and out of engagement with the bores 115 of the driven pulley 77. The vertical bores 115 are formed to extend through the drive pulley 77 to be downwardly open, and push rods 117 are slidably inserted in the vertical bores 115 so that they may be downwardly pushed by the locating push rods 101. The push rods 117 are so arranged as to project downwardly out of the driven pulley 77 into engagement with an annular friction plate 119 located just therebeneath to cooperate with an annular brake member 121 when pushed downwardly by the locating push rods 101.

The annular friction plate 119 is vertically slidably disposed around a lower reduced portion 77*r* of the driven pulley 77, and it is stopped by a plurality of pins 123 from rotating around this lower reduced portion 77*r*. Also, the annular friction plate 119 is kept upwardly biased into contact with the annular brake plate 121 by an annular spring plate 125. This spring plate is disposed around the reduced portion 77*r* of the driven pulley 77 and is held by an annular supporting plate 127 which is also fixed around the reduced portion 77*r*. On the other hand, the annular brake plate 121 is fixed by a plurality of bolts 129 on the block member 111 around the lower shaft 87 so that the annular friction plate 119 may be vertically moved into an out of contact therewith. In order to detect the connection between the annular friction plate 119 and the annular brake plate 121, an electric current is applied to the block member 111 and the brake plate 121. Therefore, the annular brake plate 121 is fixed on the block member 111 by the bolts 129 through an annular insulating member 131 and a plurality of insulating members 133.

From the above description, it will be understood that the annular friction plate 119 normally remains biased into contact with the annular brake plate 121 by the annular spring plate 125 to cooperate therewith to prevent the driven pulley 77 from rotating around the lower shaft 87. However, it will be understood that the annular friction plate 119 will be brought out of contact with the annular brake plate 121 to allow the driven pulley 77 to rotate on the lower shaft 87 to rotate the punching tool 21 when the piston 93 is lowered to push the locating push rod 101 and the push rods 117.

As will be readily understood from the above description, the driven pulley 77 of the clutch and brake means 73 will be normally kept disconnected from the driving pulley 75 since the locating push rods 101 are biased upwardly out of engagement of the vertical bores 105 of the driven pulley 77. Thus, the upper turret 13 is normally able to rotate about the shaft 17 in either direction to bring a desired pair of the upper and lower punching tools 21 and 23 into just beneath the ram 11, since the driving and driven pulleys 75 and 77 are disconnected from each other. Also, the driven pulley 77 will normally be kept fixedly stopped from rotating by the annular friction plate 119 and the annular brake plate 121 to prevent the holding member 37 and the upper punching tool 21 from rotating in the upper turret 13 so that the upper punching tool 21 can make accurate punching operations. However, when the motor 89 is supplied with the pneumatic or hydraulic fluid to enable the piston 93 to push the locating rods 101, the driven pulley 77 will be connected with the driving pulley 75 by the locating push rods 101 and will be driven by the driving pulley 75 to rotate the upper punching tool 21 in the upper turret 13. Of course, the driven pulley 77 will rotate the upper punching tool 21 and prevent the same from rotating in the upper turret 13 through the transmitting member 79, the idler pulley 81, the transmitting member 83 and the pulley 39 of the cylindrical holding member 37.

Although descriptions have been made about the clutch and brake means 73 for the upper punching tool 21 in the above, the clutch and brake means for the lower punching tools 23 are of the same construction as shown in FIG. 3. Of course, however, the clutch and brake means for the lower punching tool 23 is symmetrical to that for the upper punching tool 21 and is located between the underside of the lower turret 15 and the top of the base 3. In this arrangement, the clutch and brake means 73 for the upper and lower punching tools 21 and 23 are simultaneoulsy operated to synchronously rotate and stop the upper and lower punching tools 21 and 23 in the upper and lower turrets 13 and 15.

Referring again to FIG. 3, the idler pulley 81 is provided at its top with detecting means 135, such as magnets, and sensing means 137 are provided for the purpose of detecting whether or not the upper punching tool 21 is at its original location in the upper turret 13. Also, a detecting means 141 and a sensing means 143 are provided in order to detect whether or not the lower punching tool 23 is at its original location in the lower turret 15. In the preferred embodiment, the detecting means 141 is fixed to the lower holding member 44 of the lower punching tool 23 while the sensing means 143 is provided on a portion of the base 3 so that it may sense the detecting means 141 coming into close proximity thereof when the lower holding member 43 is rotated in the lower turrets. In these arrangements, the upper and lower punching tools 21 and 23 are so arranged as to be located at their original positions in the upper and lower turrets 13 and 15, respectively, when the detecting means 135 and 141 are in the close proximity to the sensing means 137 and 143, respectively. Of course, the upper and lower punching tools 21 and 23 are so arranged as to align with each other in direction to cooperate with each other to punch holes of a desired shape and size when they are located at their original positions in the upper and lower turrets 13 and 15.

As has been described above, the upper and lower punching tools 21 and 23 can be automatically synchronously rotated or indexed in the upper and lower turrets 13 and 15 in the turret punch press 1 according to the present invention. Accordingly, the upper and lower punching tools 21 and 23 can be effectively and versatilely used to accurately and economically punch a variety of holes including those which are identical in shape and size and different in direction in the turret punch press 1 according to the present invention.

Although a preferred form of the present invention has been illustrated and described, it should be understood that the device is capable of modification by one skilled in the art without departing from the principles of the invention. Accordingly, the scope of the invention is to be limited only by the claims appended hereto.

What is claimed is:

1. A turret punch press having motor-driven rotatable upper and lower turrets for punching holes in sheet materials, comprising:

a plurality of upper punching tools rotatably attached to said upper turret;

a plurality of lower punching tools rotatably attached to said lower turret;

a vertically movable ram attached to said punch press in such a manner that, upon activation, it drives at least one of said plurality of upper and at least one of said plurality of lower punching tools through said sheet material;

means for synchronously rotating said upper and lower punching tools to desired positions; and said means for synchronously rotating said upper and lower punching tools including servomotors connected to drive said rotatable plurality of upper and lower punching tools, whereby holes of the same shape but with different orientations may be punched in said sheet material.

2. A turret punch press of claim 1, further including clutch and brake means for automatically fixing said upper and lower rotatable punching tools in a desired position.

3. The turret punch press of claim 2, further including numerical control means for automatically synchronously rotating and stopping said upper and lower punching tools to continuously punch a variety of holes of identical size and shape but of different direction.

4. The turret punch press of claim 2, further including means for detecting whether said clutch and brake means are engaged with each other.

* * * * *